US009842478B2

(12) United States Patent
Bonisch et al.

(10) Patent No.: US 9,842,478 B2
(45) Date of Patent: Dec. 12, 2017

(54) SMOKE AND FIRE DETECTOR

(71) Applicant: SICK AG, Waldkirch (DE)

(72) Inventors: Andreas Bonisch, Waldkirch (DE); Jurgen Convent, Waldkirch (DE)

(73) Assignee: SICK AG, Waldkirch (DE)

( * ) Notice: Subject to any disclaimer, the term of this patent is extended or adjusted under 35 U.S.C. 154(b) by 0 days.

(21) Appl. No.: 14/727,107

(22) Filed: Jun. 1, 2015

(65) Prior Publication Data

US 2015/0371514 A1 Dec. 24, 2015

(30) Foreign Application Priority Data

Jun. 23, 2014 (DE) ..... 10 2014 108 713

(51) Int. Cl.
*G08B 17/10* (2006.01)
*G08B 17/103* (2006.01)
*G08B 17/113* (2006.01)

(52) U.S. Cl.
CPC ..... *G08B 17/103* (2013.01); *G08B 17/113* (2013.01)

(58) Field of Classification Search
CPC ..... B64D 2045/0035; B64D 45/0015; G06K 9/00771; G06K 9/626; G06K 9/629; G06K 9/6293; G06T 7/2053; G08B 17/125; G08B 17/103
USPC ..... 340/630, 628, 636.1, 634, 506, 573.1, 340/641, 642, 686.6, 691.3, 286.05, 340/815.45
See application file for complete search history.

(56) References Cited

U.S. PATENT DOCUMENTS 6,271,758 B1 * 8/2001 Nakamura ..... G08B 17/103 250/564
6,788,197 B1 * 9/2004 Thuillard ..... G08B 17/107 340/506
7,683,793 B2 * 3/2010 Li ..... G08B 7/062 340/573.1
2009/0026354 A1 * 1/2009 Nakajima ..... G01N 21/534 250/216
2015/0204781 A1 * 7/2015 Wagner ..... G08B 17/107 356/342

FOREIGN PATENT DOCUMENTS

DE 19835797 A1 3/2000
EP 0472039 A2 2/1992

OTHER PUBLICATIONS

German Office Action dated Jan. 16, 2015 corresponding to application No. 102014108713.5.

* cited by examiner

*Primary Examiner* — Daniel Previl
(74) *Attorney, Agent, or Firm* — Nath, Goldberg & Meyer; Jerald L. Meyer

(57) ABSTRACT

A smoke and/or fire detector for the detection and distance measurement of smoke (36) in a monitored zone (2), having a light transmitter (4) for transmitting a transmitted light signal (8), having a light receiver (6) for generating a received light signal (10) from the transmitted light signal (8) remitted or reflected in the monitored zone (2), and having an evaluation unit (12) for evaluating the time of flight of the received light signal (10), wherein the evaluation unit (12) has a transient recorder (14) and wherein the transient recorder (4) is configured to record multiple received light signals (10) of a single transmitted light signal (8) successively following in time in a time period and the evaluation unit (12) is configured to evaluate the received slight signals (10).

10 Claims, 4 Drawing Sheets

SMOKE AND FIRE DETECTOR

Figure 1:
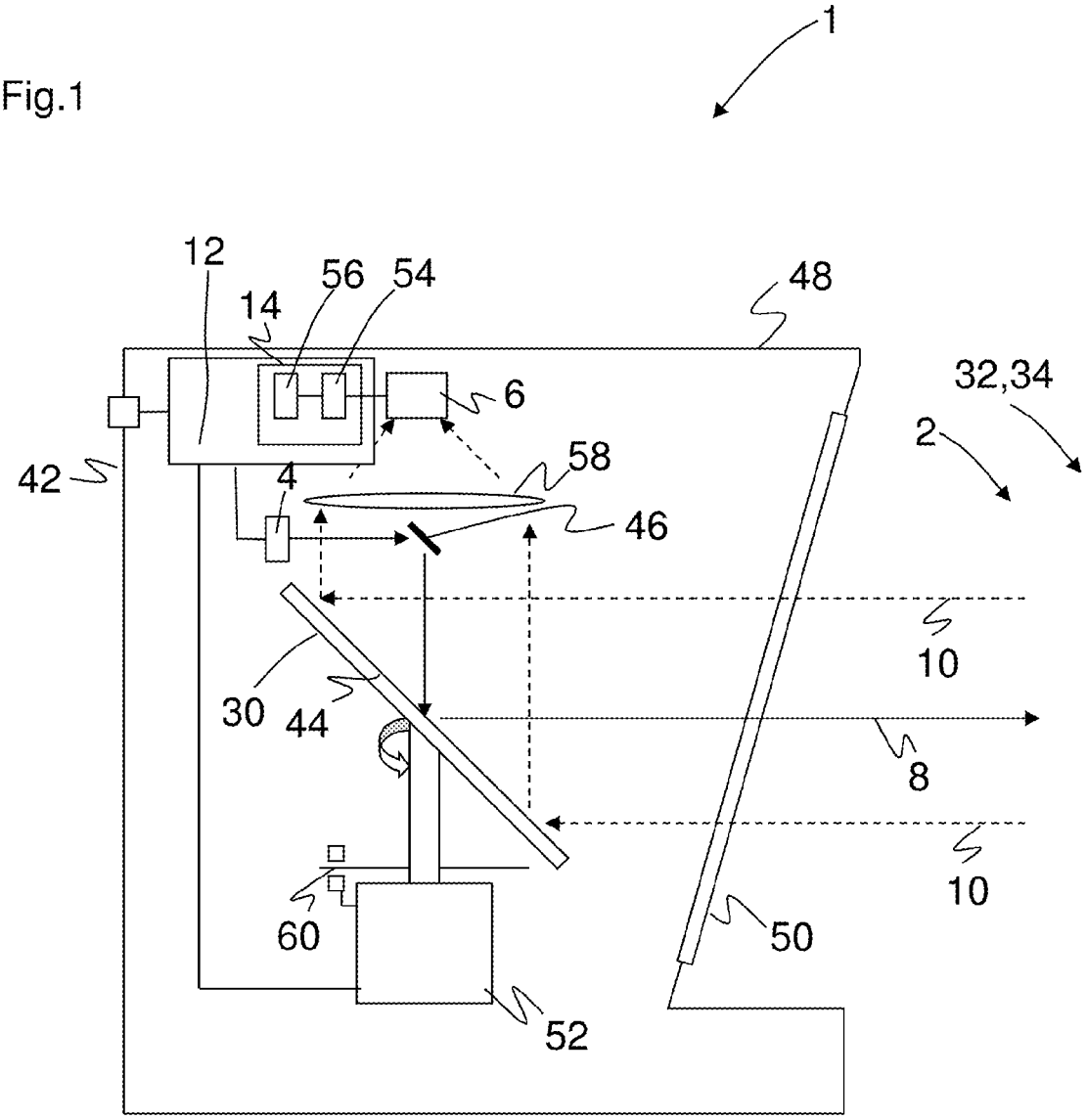

The present invention relates to a smoke and fire detector for the detection and distance determination of smoke and/or fire in a monitored zone, having a light transmitter for transmitting a transmitted light signal, having a light receiver for generating a received light signal from the transmitted light signal remitted or reflected in the monitored zone, and having an evaluation unit for evaluating the time of flight of the received light signal.

The optical smoke detectors frequently used for fire detection measure the optical transmission properties or scattering properties of the environmental air. If the particle density increases, e.g. in the case of fire, the detector signal increases in the case of optical scattered light measurement and an alarm is triggered if a threshold is exceeded. In the case of a linear transmission measurement, of so-called linear detectors, the measured transmission falls due to the increased particle density and an alarm is triggered on an exceeding of a threshold.

Due to their design, these smoke detectors based on scattered light only measure spots within a device. The environmental air enters into the device by convection or by diffusion. It is therefore necessary to position the smoke detector suitably in space to be able to detect a fire incidence fast.

The detector must in this respect necessarily be installed at the location to be monitored, which is not always easy to implement in some cases. An association of a fire incident to a detector is possible without problem with a spatial separation. It is only possible to draw a conclusion on the fire location with reference to the time delay of the alarm signals with a plurality of detectors within a space.

So-called linear detectors which measure the transmission of light over the measurement path are used for monitoring large spaces. In this technology, the fire location cannot be determined within the measurement path. There is also no possibility of drawing a conclusion on the cause of the transmission measurement. If the light beam along the measurement path is interrupted by an obstacle, this is signaled as a fire and thus generates a fire alarm.

EP 0 472 039 A2 discloses a method for fire detection in which a beam of electromagnetic radiation is emitted into a space to be monitored, the radiation returned back from said space is measured and a fire signal is generated in response to a predefined change of the measured returned radiation, wherein the transit time of the returned radiation between the emission of said radiation is measured and is compared with a previously stored reference transit time and a fire signal is generated when the measured transit time differs in a predefined manner from said stored transit time.

It is an object of the invention to provide an improved smoke detector or fire detector which delivers more information on the fire location to initiate a better estimate of or a better response to the fire.

The object is satisfied by a smoke and/or fire detector for the detection and for the distance determination of smoke and/or fire in a monitored zone, having a light transmitter for transmitting a transmitted light signal, having a light receiver for generating a received light signal from the transmitted light signal remitted or reflected in the monitored zone, having an evaluation unit for evaluating the time of flight of the received light signal, wherein the evaluation unit has a transient recorder, wherein the transient recorder is configured to record multiple light signals of a signal transmitted light signal following one another in time in a time period and the evaluation unit is configured to evaluate the received light signals.

The transient recorder is configured to carry out a data acquisition, wherein a high sampling rate can be achieved. The transient recorder for this purpose has a memory to store the sampled values.

In this respect, the total signal extent is scanned and digitized or sampled so that continual information is available in digital form for the evaluation. The large number of samplings per received light signal pulse allows an exact time determination.

The transient recorder of the invention can be a simple single-channel transient recorder. The transient recorder, for example, comprises an input amplifier, a trigger unit, a time base, an analog/digital converter and the memory.

The memory is designed, for example, as a shift register or as RAM, with only sequential memory accesses being necessary. The received light signals applied at the light receiver are digitized in the cycle of the time base and are stored sequentially in the memory. In this respect, the memory is used cyclically, that is once the last memory space has been reached, recording is continued at the first memory space and the values recorded there are overwritten.

At the same time, a check is made by the evaluation unit whether a received light signal is present which allows a detection and position determination of smoke and/or fire in the monitored zone. If this signal satisfies specific criteria, a smoke detection signal is output at an output.

The invention serves the smoke detection along an axis; in a possible restriction to part sections of the axis. Part sections of the measurement path can be defined as the monitored zone, while in other part sections a backscatter signal is not used for the smoke detection.

It is possible to distinguish between hard object surfaces such as bounding walls and non-solid objects, that is quasi-soft objects such as clouds of smoke, by evaluating the signal characteristics of the backscattered light.

The further optical properties of this cloud of smoke such as the smoke density can be output as a measured variable using a calibration stored in the smoke and/or fire detector.

In a further development of the invention, the evaluation unit has an output for outputting smoke classification signals and/or smoke classification data. Smoke classification signals can in this respect directly indicate specific fire incidents. Smoke classification data furthermore output data on the kind of the fire incident; for example, values can thus be given within a scale to classify the fire incident. Fire combating measures can also be directly started directly on the basis of the classification signals.

In a further development of the invention, the evaluation unit is configured to acquire a first distance and a second distance and thereby to detect a first extent of a cloud of smoke. Starting from the transmitted light signal, a first received light signal is detected at a cloud of smoke, for example, when the transmitted light signal is detected at the start of the cloud of smoke. A first distance is acquired on the basis of this first received light signal. However, at least one second received light signal is remitted within the cloud of smoke on the basis of the transmitted light signal, whereby a second distance is acquired. A minimum extent of the cloud of smoke can then be detected on the basis of these distances.

In accordance with a further development of the invention, the evaluation unit is configured to acquire first distances and second distances successively on the basis of transmitted light signals successively transmitted and on the basis of received light signals thereof received successively and to detect the speed and/or extension speed of the cloud of smoke from these distances. The extent of the fire can be evaluated better on the basis of the speed of the cloud of smoke or of the fire and/or on the extension speed and the deployment for the fire combating can take place more directly.

In a further development of the invention, the evaluation unit is configured to evaluate the signal level of the received light signals and to determine a smoke density from it. The denser the smoke, the higher the remitted or reflected received light since the transmitted light signal falls over a larger number of particles. The signal level furthermore also depends on the kind or color of the smoke. The brighter the smoke, the more light is reflected back at the smoke particles.

In a further development of the invention, the evaluation unit is configured to evaluate the signal level of the received light signals successively on the basis of successively transmitted light signals and on the basis of received light signals thereof received successively and to determine a smoke density change from said evaluation. It is thereby further possible to evaluate the fire behavior directly and to initiate corresponding counter-measures.

In accordance with a preferred embodiment, the received light signals received successively in time, the determined distances and the determined signal levels are correlated with stored received light patterns, with stored distances and with stored signal levels to detect stored fire incidents. Specific classified fire incidents which can possibly be expected in specific buildings or spaces can thereby be determined directly on the basis of the correlation and corresponding information can be output via the output.

In a further development of the invention, the fire incidents are smoldering fire, fire, flame, white smoke, black smoke and/or smoke of different densities. In accordance with the present invention, these fire incidents can be distinguished in accordance with the present invention on the basis of the acquired distance values, their time change and the simultaneously measured signal lever and can be associated with the specific fire incident with a high probability.

In a particularly preferred embodiment of the invention, the transmitted light signal is deflected continuously in different first directions via a deflection mirror to form an areal monitored zone and the received light arrives at the light receiver via the deflection mirror to generate the received light signal or to acquire it with the transient recorder. An area can thereby be monitored in the space, whereby the extent of the cloud of smoke or of the fire incident in a plurality of different directions can, for example, be evaluated, whereby an even better statement on the extent of the smoke can be achieved.

In a further development of the invention, the transmitted light signal is deflected continuously in different first directions and different second directions via a deflection mirror to form a spatial monitored zone and the received light arrives at the light receiver via the deflection mirror to generate the received light signal or to acquire it with the transient recorder. A spatial zone can thereby be monitored, whereby the extent of the cloud of smoke or of the fire incident in the space can, for example, be evaluated, whereby an even better statement on the extent of the smoke can be achieved.

Figure 2:
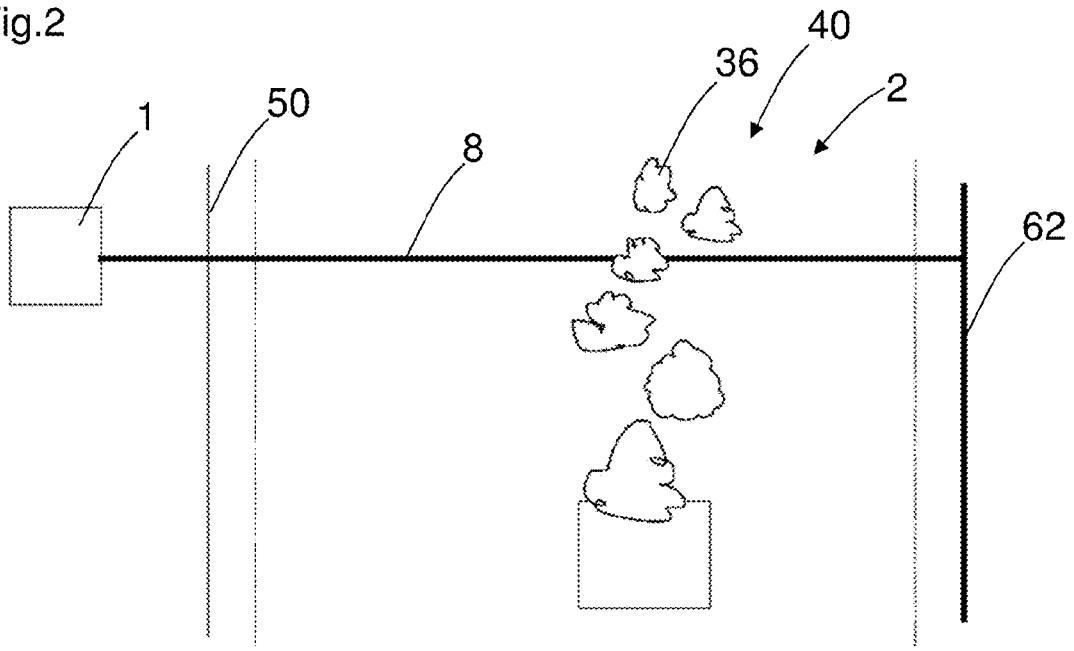
Figure 3:
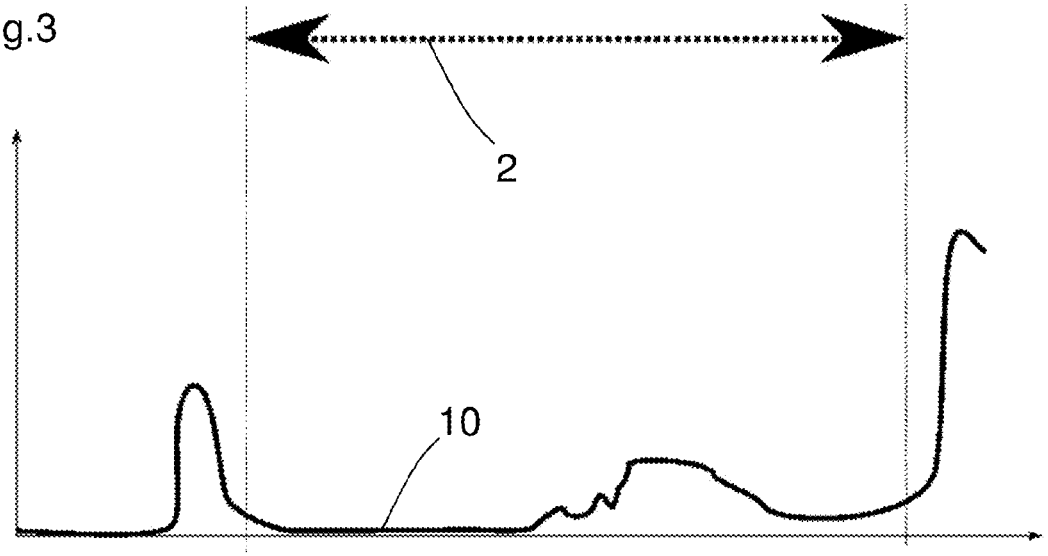
Figure 4:
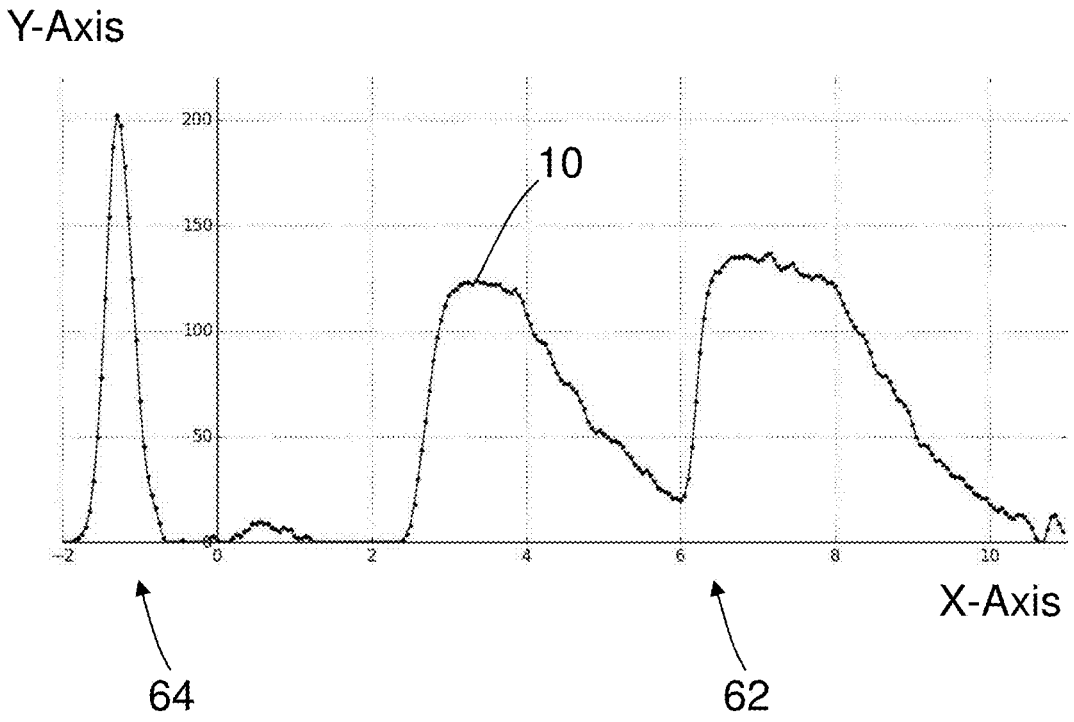
Figure 5:
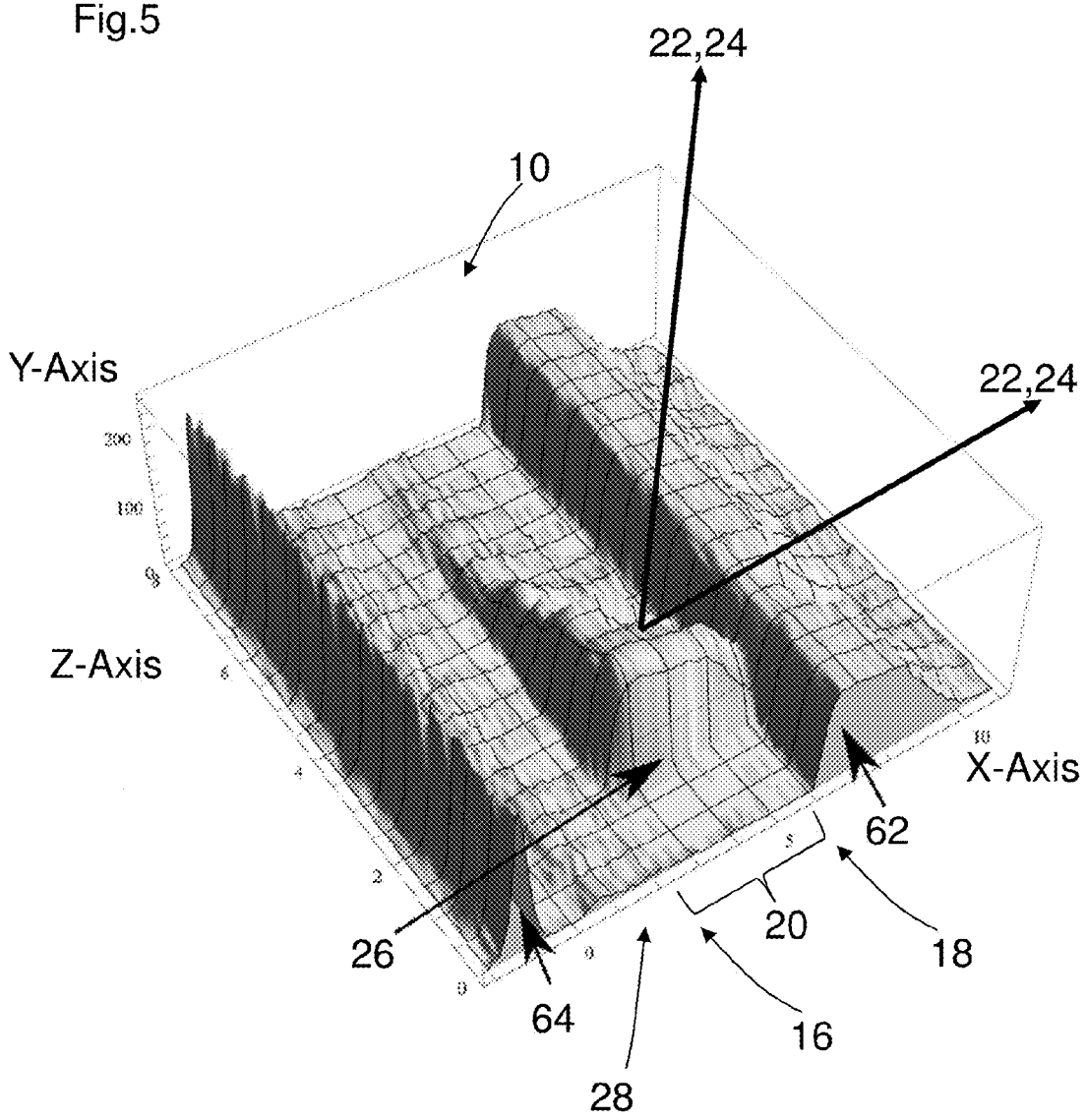

The invention will also be explained in the following with respect to further advantages and features with reference to the enclosed drawing and to embodiments. The Figures of the drawing show in:

FIG. 1 a smoke or fire detector in a schematic representation;

FIG. 2 a transmitted light signal in a monitored zone with smoke;

FIG. 3 a signal extent of a light pulse in accordance with FIG. 2 recorded using the transient recorder;

FIG. 4 a signal extent with the stored values of the transient recorder; and FIG. 5 a signal extent in accordance with FIG. 4, but recorded continuously over time.

In the following Figures, identical parts are provided with identical reference numerals.

FIG. 1 shows a smoke and/or fire detector 1 for the detection and distance determination of smoke 36 and/or fire 40 in a monitored zone 2, having a light transmitter 4 for transmitting a transmitted light signal 8, having a light receiver 6 for generating a received light signal 10 from the transmitted light signal 8 remitted or reflected in the monitored zone 2, and having an evaluation unit 12 for evaluating the time of flight of the received light signal 10, wherein the evaluation 12 has a transient recorder 14 and wherein the transient recorder 14 is configured to record multiple received light signals 10 of a single transmitted light signal 8 successively following in time in a time period and the evaluation unit 12 is configured to evaluate the received slight signals 10.

FIG. 1 shows a smoke and/or fire detector 1 in accordance with the invention in a schematic sectional representation. The invention will be described for this example, but also comprises other optoelectronic components and mechanical components for smoke detection having the properties named in the claims.

A transmitted light signal 8 which is generated by a light transmitter 4, for example by a laser, and which can comprise individual light pulses is deflected via light deflection units 46, 44 into a monitored zone 2 and is remitted by an object or by a cloud of smoke which may be present. The remission can also take place multiple times at different distances as is the case with smoke or with partly transparent objects which both reflect and transmit portions of the transmitted light signal. The remitted light again arrives back at the smoke and fire detector 1 as a received light signal 10 and is there detected by a light receiver 6 via the deflection unit 44 and by means of a reception optics 58. The received light signals 10 of the light receiver 6 are sampled using an A/D converter 54 of the transient recorder 14 and are stored in the memory 56 of the transient recorder 14. A distance from an object, an extent of the cloud of smoke, impaired visibility, a smoke density, a smoke density and a visual range can then be calculated in accordance with the invention from the recorded signals.

At a transmission time, the light transmitter 4 preferably transmits transmitted light signals 8 in the form of transmitted pulses having a transmitted pulse shape. The smoke or fire detector 1 thus initiates a pulse-based time of flight measurement. The evaluation unit 12 then preferably recognizes a received time belonging to a cloud of smoke or fire incident in the transmitted light signal 8 or transmitted light beam with reference to a received pulse in the received light signal 10. In an idealized form, the received pulse has the shape of the transmitted pulse and can practically also be recognized thereby. The time of flight for an associated detection is the difference of received time and transmitted time. With partly transparent smoke clouds, a plurality of echoes arise from the different layers or parts of the cloud of smoke or of the fire incident. This produces a superposition of the plurality of ideal received pulses.

The evaluation unit 12 is preferably configured to determine the degree of impaired visibility in accordance with the cloud of smoke with reference to the distance-dependent intensity characteristics. A signal extent to be expected can be utilized to carry out a classification of the smoke or of the fire incident. In this respect, scales are to be expected due to the extent of the impaired visibility from which so-to-say a degree of impaired visibility, and thus the smoke and the kind of smoke, can be determined.

The transmitted light signal 8 is deflected continuously in different first directions via a deflection mirror 30 or via the deflection unit 44 to form an areal monitored zone 32 and the received light arrives at the light receiver 6 via the deflection mirror 30 to generate the received light signal 10.

The transmitted light signal 8 can, however, also be deflected continuously in different first directions and in different second directions via a deflection mirror 30 to form a spatial monitored zone 34 so that the received light arrives at the light receiver 6 via the deflection mirror 30 to generate the received light signal 10.

The light deflection unit 44 is configured as a rule as a rotating mirror which rotates continuously by the drive of a motor. Alternatively, a measurement head, including the light transmitter 4, can rotate. The respective angular position is detected via an encoder 60. The light beam thus sweeps over the monitored zone 2 generated by the rotational movement. If a reflected light signal received by the light receiver 6 is received from the monitored zone 2, a conclusion can be drawn by means of the encoder 60 from the angular position of the light deflection unit 44 on the angular position of the reflection or remission in the monitored zone 2.

In addition, the transit time of the individual light pulses is determined from their transmission up to their reception after reflection at the cloud of smoke in the monitored zone 2. A conclusion is drawn from the time of flight, using the speed of light, on the distance of the cloud of smoke or of the fire incident from the smoke or fire detector. This evaluation is carried out on the basis of a received light signal 10 of the light receiver 6 sampled in the analog/digital converter 54 in the evaluation unit 12 which is also connected, apart from to the A/D converter 54, indirectly to the light transmitter 4, and directly to the motor 52 and to the encoder 60.

Two-dimensional polar coordinates of the cloud of smoke or of the fire incident in the monitored zone are thus available via the angle and via the distance. All the measured values can be output via a output 42. The evaluation unit 12 has the output 42 for outputting smoke classification signals and/or smoke classification data. All the named functional components are arranged in a housing 48 which has a front screen 50 in the region of the light exit and of the light entry.

FIG. 2 shows a transmitted light signal 8 in a monitored zone 2 with a cloud of smoke 36 and with a rear wall 62 which bounds the monitored zone 2.

FIG. 3 schematically shows a signal extent of a light pulse in accordance with FIG. 2 recorded using the transient recorder 14 in accordance with FIG. 1 with a free monitored zone 2 in which the front screen 50 is detected by the remitted light as the first pulse, the smoke 36 is detected as a pulse group and a rear wall 62 in accordance with FIG. 2 is detected as the last pulse.

FIG. 4 shows an exemplary intensity extent or signal extent of the sampled received light signal 10 and the evaluation unit evaluates said extent as a digital curved line. A strong signal maximum of a reference transmitted pulse of the transmitted light signal first results at a transmitted time which is included in the intensity extent as a reference for the time of flight measurement. The distance of the X axis is set to the value zero distance units, for example 0 meters, on the basis of the reference transmitted pulse. After exiting the smoke or fire detector, a plurality of remission maxima having different received times result on the basis of a cloud of smoke. This intensity extent having the different remission maxima is recorded by the transient recorder.

FIG. 4 shows the signal extent with the individual stored values of the transient recorder. In this respect, the first pulse is the transmitted pulse of the transmitted light signal 64 which serves as a reference for the time of flight measurement. In this respect, the distance in meters is indicated on the X axis. In this respect, the signal amplitude is indicated on the Y axis. In this respect, a plurality of received light signal pulses are shown in the range from 0 to approximately 2 m having an amplitude of up to approximately 15 units which are interpreted as background noise. From approximately 2.5 m onward, received light signal pulses follow up to an amplitude of approximately 125 units which were generated on the basis of smoke. The transmitted light signal was reflected by a solid rear wall 62 at a distance of 6 m.

FIG. 5 shows a signal extent in accordance with FIG. 4, but recorded continuously over time. The X axis and the Y axis are in this respect identical with FIG. 4. In this respect, the first pulse is the transmitted pulse of the transmitted light signal 64 which serves as a reference for the time of flight measurement. In this respect, the distance in meters is indicated on the X axis. In this respect, the signal amplitude is indicated on the Y axis. The transmitted light signal was reflected by a solid rear wall 62 at a distance of 6 m.

The measurement duration in minutes is indicated on the Z axis. In this respect, a transmitted light signal was output constantly and its received light signal was recorded and evaluated by the transient recorder.

In this respect, received light signals which represent a fast expanded cloud of smoke 26 are detected after approximately two minutes at a distance of approximately two to six meters. In the further minutes, the cloud of smoke 26 reduces continuously until it has again completely disappeared after eight minutes.

The evaluation unit 12 in accordance with FIG. 1 is configured to acquire a first distance 16 and a second distance 18 and thereby to detect a first extent 20 of the cloud of smoke 26.

The evaluation unit 12 in accordance with FIG. 1 is furthermore configured to acquire successively first distances 16 and second distance 18 on the basis of transmitted light signals 8 transmitted successively and on the basis of received light signals 10 thereof received successively and to detect the speed 22 and/or the extent speed 24 of the cloud of smoke 26.

The evaluation unit 12 is furthermore configured to evaluate the signal level or the amplitude of the received light signals 10 and to determine a smoke density therefrom. The evaluation unit 12 is furthermore configured to evaluate successively the signal level of the received light signals 10 on the basis of transmitted light signals 8 transmitted successively and on the basis of received light signals 10 thereof received successively and to determine a smoke density change from said evaluation. In accordance with FIG. 5, the smoke density reduces over time.

The received light signals 10 received successively in time, the determined distances 16, 18 and the determined signal levels are correlated with stored received light signal patterns, with stored distances and with stored signal levels to detect stored fire incidents 28. At least the fire incidents 28 of smoldering fire, fire, flame, white smoke, black smoke and/or smoke of different densities can thereby be distinguished.

REFERENCE NUMERALS

1 smoke and/or fire detector
2 monitored zone
4 light transmitter
6 light receiver
8 transmitted light signal
10 received light signal
12 evaluation unit
14 transient recorder
16 first distance
18 second distance
20 extent
22 speed
24 extension speed
26 cloud of smoke
28 fire incident
30 deflection mirror
32 areal monitored zone
34 spatial monitored zone
36 smoke
40 fire
42 output
44 light deflection unit
46 light deflection unit
48 housing
50 front screen
52 motor
54 A/D converter
56 memory
58 reception optics
60 encoder
62 rear wall
64 transmitted pulse of the transmitted light signal

The invention claimed is:

1. A smoke and/or fire detector for detection and distance determination of smoke and/or fire in a monitored zone, comprising:

a light transmitter for transmitting a transmitted light signal;

a light receiver for generating a received light signal from the transmitted light signal remitted or reflected in the monitored zone; and an evaluation unit for evaluating a pulse-based time of flight of the received light signal, wherein the evaluation unit has a transient recorder, with the transient recorder being configured to record multiple received light signals of a single transmitted light signal following one another in time in a time period and the evaluation unit is configured to evaluate the received light signals, and wherein the received light signals received successively in time, the determined distances, and the determined signal levels are correlated with stored received light signal patterns, with stored distances, and with stored signal levels to detect stored fire incidents.

2. The smoke and/or fire detector in accordance with claim 1, wherein the evaluation unit has an output for outputting smoke classification signals and/or smoke classification data.

3. The smoke and/or fire detector in accordance with claim 1, wherein the evaluation unit is configured to acquire a first distance and a second distance and to detect a first extent of a cloud of smoke.

4. The smoke and/or fire detector in accordance with claim 1, wherein the evaluation unit is configured to acquire successively first distances and second distances on the basis of transmitted light signals transmitted successively and on the basis of received light signals received successively, and to detect the speed and/or the extension speed of the cloud of smoke from the transmitted light signals transmitted successively and the received light signals received successively.

5. The smoke and/or fire detector in accordance with claim 1, wherein the evaluation unit is configured to evaluate the signal level of the received light signals and to determine a smoke density from the evaluated signal level.

6. The smoke and/or fire detector in accordance with claim 1, wherein the evaluation unit is configured to evaluate the signal level of the received light signals successively on the basis of transmitted light signals transmitted successively and on the basis of received light signals successively received and to determine a smoke density change from said evaluation.

7. The smoke and/or fire detector in accordance with claim 1, wherein the fire incidents are smoldering fire, fire, flame, white smoke, black smoke and/or smoke of different densities.

8. The smoke and/or fire detector in accordance with claim 1, wherein the transmitted light signal is deflected continuously in different first directions via a deflection mirror to form an area monitored zone and the received light arrives at the light receiver via the deflection mirror to acquire the received light signal using the transient recorder.

9. The smoke and/or fire detector in accordance with claim 1, wherein the transmitted light signal is deflected continuously in different first directions and different second directions via a deflection mirror to form a spatial monitored zone and the received light arrives at the light receiver via the deflection mirror to acquire the received light signal using the transient recorder.

10. A smoke and/or fire detector for detection and distance determination of smoke and/or fire in a monitored zone, comprising:

a light transmitter for transmitting a transmitted light signal;

a light receiver for generating a received light signal from the transmitted light signal remitted or reflected in the monitored zone; and an evaluation unit for evaluating a pulse-based time of flight of the received light signal, wherein the evaluation unit has a transient recorder, with the transient recorder being configured to record multiple received light signals of a single transmitted light signal following one another in time in a time period and the evaluation unit is configured to evaluate the received light signals, wherein the received light signals received successively in time, the determined distances, and the determined signal levels are correlated with stored received light signal patterns, with stored distances, and with stored signal levels to detect stored fire incidents, and wherein the transmitted light signal is deflected continuously in different first directions and different second directions via a deflection mirror to form a spatial monitored zone and the received light arrives at the light receiver via the deflection mirror to acquire the received light signal using the transient recorder.

* * * * *